United States Patent [19]

Byrne et al.

[11] Patent Number: 4,468,299

[45] Date of Patent: Aug. 28, 1984

[54] FRICTION WELDED NONCONSUMABLE ELECTRODE ASSEMBLY AND USE THEREOF FOR ELECTROLYTIC PRODUCTION OF METALS AND SILICON

[75] Inventors: Stephen C. Byrne, Monroeville; Siba P. Ray, Pittsburgh, both of Pa.; Robert A. Rapp, Columbus, Ohio

[73] Assignee: Aluminum Company of America, Pittsburgh, Pa.

[21] Appl. No.: 451,071

[22] Filed: Dec. 20, 1982

[51] Int. Cl.[3] ..... C25C 3/00; C25C 3/04; C25C 3/26; C25C 3/12

[52] U.S. Cl. ..... 204/60; 204/64 R; 204/64 T; 204/66; 204/67; 204/70; 204/286; 204/292

[58] Field of Search ..... 204/60, 64 R, 64 T, 204/66, 67, 70, 286, 243 R, 290 R, 292

[56] References Cited

U.S. PATENT DOCUMENTS

| | | | |
|---|---|---|---|
| 3,022,195 | 2/1962 | Hackley et al. | 117/123 |
| 3,152,871 | 10/1964 | Matchen | 29/195 |
| 3,284,174 | 11/1966 | Zimmer | 29/183.5 |
| 3,414,963 | 12/1968 | Cheng | 29/470.3 |
| 3,718,550 | 2/1973 | Klein | 204/67 |
| 3,839,779 | 10/1974 | Walker | 29/472.9 |
| 3,911,553 | 10/1975 | Burgess et al. | 228/173 |
| 3,915,369 | 10/1975 | Schmidt-Bruecken et al. | 228/194 |
| 3,960,678 | 6/1976 | Alder | 204/67 |
| 3,993,411 | 11/1976 | Babcock et al. | 403/271 |
| 3,994,430 | 11/1976 | Cusano et al. | 228/122 |
| 4,187,155 | 2/1980 | DeNora | 204/67 |

OTHER PUBLICATIONS

Billehaug, Kari and Oye, H. A., "Inert Anodes for Aluminum Electrolysis in Hall-Heroult Cells (I)", *Aluminium*, vol. 57, #2, 1981, pp. 146-150.

Billehaug, Kari and Oye, H. A., "Inert Anodes for Aluminum Electrolysis in Hall-Heroult Cells (II)", *Aluminium*, vol. 57, #3, 1981, pp. 228-231.

*Primary Examiner*—Howard S. Williams

*Attorney, Agent, or Firm*—Max L. Williamson

[57] ABSTRACT

A nonconsumable electrode assembly suitable for use in the production of metal by electrolytic reduction of a metal compound dissolved in a molten salt, the assembly comprising a metal conductor and a ceramic electrode body connected by a friction weld between a portion of the body having a level of free metal or metal alloy sufficient to effect such a friction weld and a portion of the metal conductor.

16 Claims, 7 Drawing Figures

FRICTION WELDED NONCONSUMABLE ELECTRODE ASSEMBLY AND USE THEREOF FOR ELECTROLYTIC PRODUCTION OF METALS AND SILICON

The Government has rights in this invention pursuant to Agreement No. DE-FC07-80CS40158 awarded by the U.S. Department of Energy.

BACKGROUND OF THE INVENTION

This invention relates to a method of connecting a metallic electrical conductor to an electrically conductive ceramic electrode body to make an electrode assembly which is suitable for use in producing metal by electrolysis.

A number of materials including silicon and metals such as aluminum, lead, magnesium, zinc, zirconium, and titanium for example, can be produced by electrolytic processes. Although individual processes may vary in some respects from one to another, each employs the use of an electrode which must operate in a highly corrosive environment.

An example of such a process for the production of metal is the well-known Hall-Heroult process (hereinafter referred to as the Hall process) for producing aluminum in which alumina dissolved in a molten fluoride salt bath is electrolyzed at temperatures from 900° C. to 1000° C. In the process as generally practiced today, carbon is used as an anode to reduce the alumina, and the reduction produces molten aluminum, and the carbon is oxidized to primarily form $CO_2$ which is given off as a gas. Despite the common usage of carbon as anode material in practicing the Hall process, there are a number of disadvantages to its use.

Since carbon is consumed in relatively large quantities in the Hall process, approximately 420 to 550 kg per ton of aluminum produced, the anode must be constantly repositioned or replenished to maintain the proper spacing with the cathode in the cell to produce aluminum efficiently. If prebaked anodes are used, it may be seen that a relatively large facility is needed to produce sufficient anodes to operate an aluminum smelter. Furthermore, to produce the purity of aluminum required to satisfy primary aluminum standards, the anode must be relatively pure carbon, and availability and cost of raw materials to make the carbon are of increasing concern to aluminum producers.

Because of the disadvantages inherent in the use of carbon as an anode, there has been a continuing search for inert or nonconsumable materials that can operate as an anode with a reasonable degree of electrochemical efficiency and withstand the high temperature and extremely corrosive environment of the molten salt bath. A number of different types of materials have been suggested and tried, including ceramic oxides, metals and ceramic transition metal borides and carbides, and gaseous fuels, such as natural gas or hydrogen, as the reactant in fuel-cell type anode. From published literature, few, if any, materials tried will survive for a prolonged time in an aluminum electrolysis cell; however, some ceramic oxides have been reported to be corrosion resistant during cell operation. A recent review of literature and patents relating to inert anodes for use in producing aluminum may be found in articles entitled "Inert anodes for aluminum electrolysis in Hall-Heroult cells (I)" by Kari Billehaug and H. A. Oye, Volume 57, #2, Aluminum, 1981, and "Inert anodes for aluminum electrolysis in Hall-Heroult cells (II)" by Kari Billehaug and H. A. Oye, Volume 57, #3, Aluminum, 1981.

A major problem in the development and use of nonconsumable anodes for producing aluminum by electrolysis has been that of providing a satisfactory method for making a connection between an electrically conductive ceramic material and a metal conductor leading from the cell to a power source. In a typical operation of a Hall cell using carbon as the anode, the anode is formed into a block having a rectangular cross section and a metallic rod or bar is embedded therein by providing a hole in the block, inserting the rod in the hole and filling the void between the rod and the block with molten iron. When the iron solidifies, it shrinks tightly around the bar and away from the hole surfaces of the carbon block, but disengagement is prevented by adapting the block so as to engage the solidified iron. Such an adaptation is providing recesses in the hole side wall, for example. When the above-described assembly is positioned in a Hall cell having a salt bath which is maintained at approximately 1000° C., the rod, cast iron and carbon in the connection zone rise in temperature from room temperature to approximately 700° to 800° C. The rod, cast iron and carbon in the connection zone expand due to this temperature rise and a substantially tight and reasonably efficient electrical connection is effected. Because the rod and cast iron are relatively free to expand longitudinally, the principal electrical contact between the body and the metal due to the thermal expansion is along the lateral surfaces.

When ceramic materials are used for anode bodies, however, such a connection is not satisfactory for a number of reasons.

When using carbon as the anode body, it is desirable that it be in a block form because it is consumed during the electrolytic process and a large block or mass minimizes the frequency with which anodes must be replaced. It is not desirable, on the other hand, to provide an anode of ceramic materials in a large mass or block because, typically, ceramic anode bodies are more expensive to make than are carbon anode bodies, and the carbon materials are typically better conductors of electricity than are ceramic materials used in inert anodes.

As has been previously noted, the carbon anode to metal bar connection utilizing cast iron as the connecting medium relies primarily upon the lateral surfaces of the cast iron being in substantially tight contact with the lateral surfaces adjacent to the hole in the carbon block to effect a reasonably satisfactory electrical connection. Variations in electrical conductivity of such a connection due to such things as irregularities in the cast iron and carbon block surfaces, for example, may be tolerated because of the relatively short time span over which an individual carbon block functions as an anode. In the case of an anode made from ceramic materials, however, most of the ceramic materials which are suitable for use as anodes are less efficient electrical conductors than carbon and, furthermore, to be effective, the anode must function over an extended period of cell operation time. Assuring a continuous intimate contact between the ceramic anode body and metal conductor is considered to be more critical, therefore, than the contact required between a carbon block and metal conductor.

Ideally, the connection of a nonconsumable anode material to a metal conductor for use in the electrolytic production of metal must be corrosion resistant, have a minimal voltage drop across the connection, and function to maintain the integrity of the ceramic material when subjected to temperature differentials on the order of 1000° C.

A number of methods for making connections of ceramic materials to metal conductors in the electrolytic production of aluminum have been proposed. Klein U.S. Pat. No. 3,718,550 proposes three different methods. In one of the methods, a ceramic anode tube, having a closed end, contains molten silver and a titanium carbide rod connected to a current supply extends down into the molten silver pool. In a second method, the inner surface of the tube is covered with a thin layer of silver or platinum and a hollow cylinder of nickel-alloy wire mesh is inserted into the tube to contact the silver or platinum layer and is connected with nickel-alloy wires to a conductor leading to the current supply. In the third method, the closed-end ceramic anode tube contains nickel powder, and a rod of zirconium diboride connected to a conductor leading to the current supply is inserted into the nickel powder. Alder U.S. Pat. No. 3,960,678 shows ceramic anode bodies of various shapes in contact with the electrolyte. Adjacent to the anode, but not in contact with the electrolyte, is a material designated as a current distributor which may be a metal such as Ni, Cu, Co, Mo or molten silver or a nonmetallic material such as a carbide, nitride or boride. Power leads connected to the current distributor may be made of the same materials, and it is suggested that the current distributor and power lead may be a single piece. The patentee does not describe how the various connections are to be made. De Nora et al U.S. Pat. No. 4,187,155 suggests attaching lead-in connectors to ceramic electrodes by fusing the connector into the electrode during the molding and sintering process or by making an attachment after sintering, but does not describe any method for making such attachments so as to avoid fracture of the ceramic in use.

Suggestions or descriptions for making metal bonds between ceramics and metals by welding, brazing or other methods of metal bonding have been made. Patents dealing with such methods, for example, are Hackley et al U.S. Pat. No. 3,022,195, Cheng U.S. Pat. No. 3,414,963, Matchen U.S. Pat. No. 3,152,871, Zimmer U.S. Pat. No. 3,284,174, Walker U.S. Pat. No. 3,839,779, Burgess et al U.S. Pat. No. 3,911,553, Schmidt-Bruecken et al U.S. Pat. No. 3,915,369, Babcock et al U.S. Pat. No. 3,993,411 and Cusano et al U.S. Pat. No. 3,994,430. None of these patents, however, are concerned with connecting an electrically conductive metallic oxide ceramic electrode body to a metal conductor for use in producing a metal by electrolysis. Heretofore, it has not been believed possible to make such a connection in producing a metal because of fracture or failure of the joint due to expansion and/or contraction of the assembly over the extreme temperature differential involved in production of metal by electrolysis.

It would be desirable, therefore, to provide a method for joining a ceramic body to a metal conductor for use in producing metal by electrolysis.

SUMMARY OF THE INVENTION

This invention is for an assembly of a nonconsumable ceramic electrode body and a metal conductor which is suitable for use in the production of metal by electrolytic reduction of a metal compound dissolved in a molten salt. The assembly is effected by friction welding a portion of the metal conductor to a portion of the ceramic body and producing a metal bond thereby between the ceramic body and metal conductor. The ceramic body may be comprised of any ceramic and/or combinations of metals and ceramics which are suitable for use as an electrode in a process for producing a metal by electrolysis and include in at least the portion of the body to be connected to the metal conductor a level of free metal or metal alloy sufficient to effect a metal bond. It is to be understood that the word "ceramic" as used herein with reference to this invention is intended to include those combinations of ceramics and metals commonly referred to as cermets. In the practice of this invention, such free metal or metal alloy of such ceramic must have a higher melting temperature than the maximum temperature the ceramic body will be subject to during the operation of a cell in producing a particular metal by electrolysis. In producing aluminum, for example, ceramics which include Ni or NiFe as a free metal or metal alloy are suitable for use in an assembly of this invention, but the subject invention is not limited to the examples just cited. Other free metals or metals which may combine to produce metal alloys include, for example, Fe, Al, Mg, Ca, Co, Sn, Ti, Cr, Mn, Zr, Cu, Nb, Ta, Li, Y, Pt, Pd and Ir. Further, the scope of this invention is intended to include any electrode body which may have a suitable ceramic layer as an exterior surface. For example, it has been suggested that an electrode might be made by flame spraying or plasma spraying a coating of ceramic material onto a base material such as titanium, nickel, copper, a carbide, a nitride, etc. Ceramic materials which have shown the best potential heretofore for use as nonconsumable electrodes in an electrolytic process for producing metal are metal oxides and combinations of metals and metal oxides called cermets, but it is not intended that this invention is limited to metal oxide and/or cermet materials.

The free metal or metal alloy may be provided by at least partially reducing by the use of a suitable reductant at least one of the metal compounds present in the ceramic body in an area where the metal bond is to be effected. Other methods of providing an essentially metallic connecting surface on the anode might also be suitable. For example, free metal might be provided in a cermet by introducing metal particles into a ceramic mixture prior to sintering. As an alternative, a layer of metal might be applied to the surface of the ceramic body to be connected by plating, plasma spraying or chemical vapor deposition, for example. After providing the metal in a manner proposed by the foregoing examples, a metal bond between the ceramic anode body and metal conductor rod can be made.

The metal conductor may be any metal that is suitable for use as a conductor in a particular electrolytic process, can be joined to the electrode body by friction welding, and is compatible with the electrode in the cell environment. That is, no adverse reaction between the ceramic material and the metal arises from the connection of the two materials.

For purposes of this invention, the term "metal bond" is intended to mean a bond that is formed between the metal conductor and the free metal or metal alloys in the ceramic body as may be accomplished by friction welding. "Friction welding" is intended to mean any method of welding whereby the heat necessary to effect the weld between the two bodies is generated by friction between the two bodies, and includes such welding methods known as inertia welding, for example.

It is an object of this invention to provide an assembly between a nonconsumable ceramic electrode body and a metal conductor that is suitable for use in producing metal by an electrolytic process and is economical, reliable and efficient in such use. This and other objects and advantages will be more apparent with reference to the following description of a preferred embodiment and the accompanying drawings.

DESCRIPTION OF A PREFERRED EMBODIMENT

For convenience, a preferred embodiment of this invention will be described with reference to producing aluminum by electrolysis, but the scope of the invention is intended to include its use in the production of other metals by electrolysis as well.

In this preferred embodiment any ceramic material may be used for the body that is suitable for use as an anode in the electrolytic production of aluminum and includes therein at least in the portion of the body to be joined to the metal conductor a level of free metal or metal alloy sufficient to effect a metal bond between the conductor and ceramic body by friction welding. A preferred composition of the ceramic body is comprised of metal oxides and a more preferred composition of materials is 20 wt.% Fe, 60 wt.% NiO and 20 wt.% $Fe_3O_4$. To make an anode body to be used in the practice of this invention, the foregoing materials are placed in a suitably shaped mold and are reaction sintered in an argon atmosphere at a temperature of approximately 1275° to 1350° C. for approximately four hours under a pressure of approximately 25,000 psi (172 MPa). Such reaction sintering results in an interwoven network of metallic material and oxides, the metallic material containing Ni-Fe alloy and the oxide material containing (Ni,Fe)O and $Ni_xFe_{3-x}O_4$. For purposes of this invention, the shape of the body is not critical; it may be of any shape or configuration which provides an accessible surface for making a metal bond with the metal conductor by friction welding.

Figure 1:
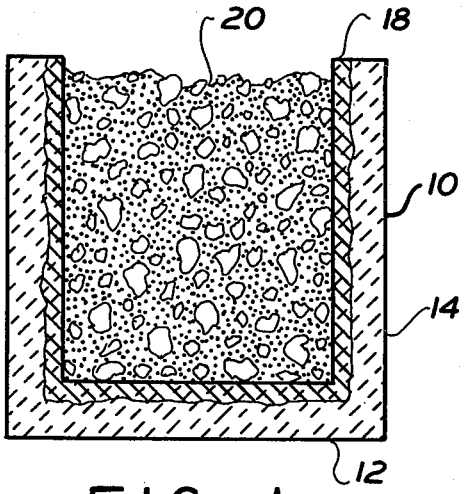
FIG. 1 is a cross-sectional view of an electrode body of an assembly of this invention with a reductant in contact with a portion of the body.
Figure 2:
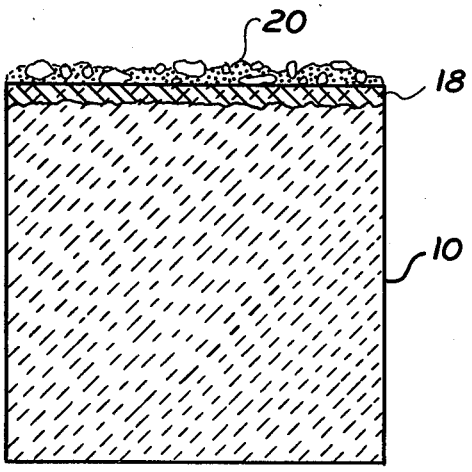
FIG. 2 is a cross-sectional view of an alternate electrode body of an assembly of this invention with a reductant in contact with a portion of the body.

Shapes suitable for an assembly of this invention are shown in FIGS. 1 and 2. Referring to FIG. 1, the anode body 10 is a cylindrical cup having a bottom wall 12 and side wall 14. The thickness of the walls need be only that which is adequate to provide the structural strength necessary for the size of anode body required and the corners of the cup may be provided with a radius if desired. The anode body 10 in FIG. 2 is a cylindrical solid, but may be of any desired cross section adaptable for mounting in apparatus for effecting a metal bond by friction welding, which will be explained later.

To provide an appropriate connecting surface on the anode body, an area of connection is reduced by contacting the area with a reducing agent, such as carbon for example, and sufficient heat is applied to reduce the metal oxide or oxides to a metal or metallic alloy. The manner of using carbon as the reducing agent is not critical to the practice of this invention, and suitable temperatures and time to accomplish the desired reduction would be known to one skilled in the art. Typically, the cup 10 as shown in FIG. 1 is filled with a carbonaceous material 20 and heated to a temperature greater than 900° C. to at least partially reduce a zone 18 of the metal oxide material at and adjacent to the surfaces contacted by the carbonaceous material. The time of heating may vary depending upon the extent of reduction desired. An anode body 10, such as that shown in FIG. 2, is simply layered with a carbonaceous material 20 and processed in a manner as described for processing the anode body shown in FIG. 1. Typically, it is believed that the composition of the material in the reduced zone 18 is comprised of Ni, NiFe alloy as free metal and metal alloy in a ceramic matrix of (Ni,Fe)O and $Ni_xFe_{3-x}O_4$.

It is believed that by varying the time and/or temperature of heating, zone 18 could be reduced to substantially all free metal or metal alloy. The extent of reduction required, however, is only that necessary to effect a metal bond between the metal conductor and the ceramic body of sufficient strength to maintain the assembly during its intended use as an anode in an electrolytic process for producing aluminum.

As an alternative to the use of carbon as a reductant, heating in the presence of hydrogen or a hydrogenous material is a satisfactory method for reducing the metal oxide or oxides to primary metals or metal alloys. Thus, a portion of the anode body is converted to a section that is highly resistant to thermal shock and has a layer including free metal or metal alloy which blends into the ceramic oxide body through a transition zone of variable composition.

Figure 3:
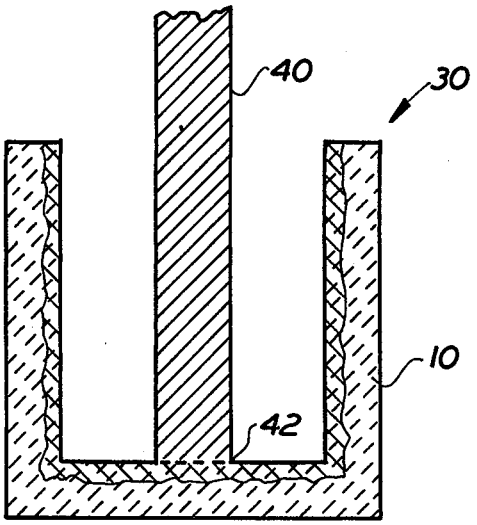
FIG. 3 is a cross-sectional view of an inert electrode assembly of this invention which includes the electrode body shown in FIG. 1.
Figure 4:
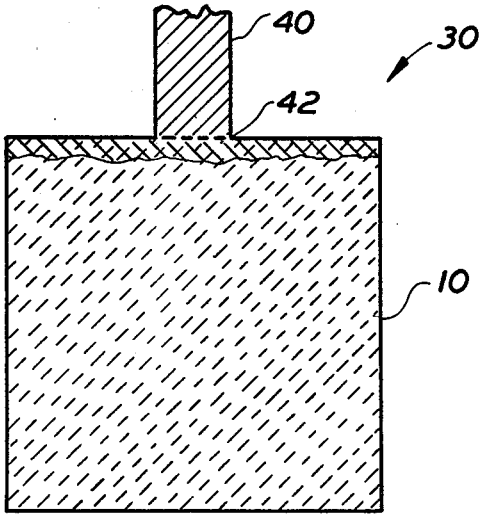
FIG. 4 is a cross-sectional view of an inert electrode assembly of this invention which includes the electrode body shown in FIG. 2.

To effect a metal bond 42 and make an assembly 30 between the ceramic body and metal conductor, as shown in FIGS. 3 and 4, a metallic rod or bar 40 is welded to the reduced section of the anode body 10 by friction welding, preferably by inertia welding, as will now be described. The rod or bar may be comprised of any metal or alloy suitable for attachment by friction welding to the particular metallic surface of the anode body. The embodiment shown in FIG. 3 may be advantageous in making a friction weld between the ceramic body and metal conductor because less ceramic material is required to make a body having equivalent surface are than if a solid body such as that shown in FIG. 4 were employed.

Where the surface of the body to be joined contains Ni and NiFe, for example, a suitable rod or bar is comprised of Ni or Ni alloy, but it is apparent that other metal alloys capable of being joined by friction welding could also be used as metal conductors.

In one method of friction welding, the conductor rod and ceramic body workpieces to be joined are coaxially mounted in opposed chucks of a lathe with the surfaces to be joined adjacent each other. One chuck is fixed and the other is adapted to rotate in relation to the fixed chuck, and means for applying an axial force through one workpiece against the other workpiece is also provided.

To effect a weld, the rotatable chuck is caused to rotate at a predetermined speed and, while rotating, axial pressure is applied from one of the workpieces to the other workpiece for a brief time, and then the pressure is released momentarily. The application and release of pressure cycle is then repeated sequentially until the workpieces have been heated sufficiently by friction between the surfaces to be joined to effect a plastic or semi-molten condition in at least one of the workpieces, at which point rotation of the chuck is stopped and sufficient axial pressure is applied from one workpiece to the other to effect a union of metal particles in one workpiece with metal particles in the other workpiece and thus make a connection having a zone of metal particles from one workpiece merged with metal particles from the other workpiece. The speed of rotation, pressures, times of pressure application and other parameters of the method vary with the types of material and sizes of the bodies to be joined.

A preferred method of friction welding is designated as inertia welding and is preferred over a method such as that just described because it is faster, and the heat zone from the generated friction is more localized and more generally confined to the connection area.

In inertia welding, the apparatus for making the weld is substantially the same as that described above except an inertial mass or flywheel and clutch are provided on the shaft of the rotating chuck.

To make an inertial weld, the workpieces to be joined are mounted in the chucks with the surfaces to be joined opposed to each other, and the shaft having the rotating chuck and the flywheel thereon is brought up to a predetermined speed, at which point axial pressure is applied through the parts for a brief time, the clutch is then disengaged and, while maintaining axial pressure, rotation is continued from the energy of the rotating flywheel until the flywheel stops. Through selection of the proper flywheel mass, pressure and length of time to sustain the pressure for the given materials and size of parts, a connection such as that previously described as produced by friction welding may be effected.

Figure 6:
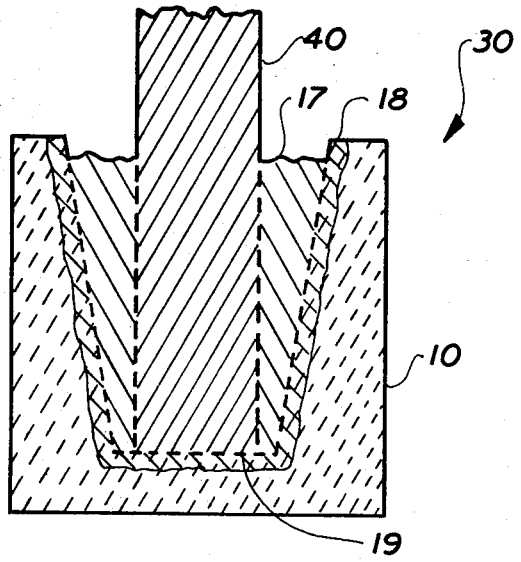
FIG. 6 is a cross-sectional view of the elements shown in FIG. 5 after friction welding into an assembly of this invention.
Figure 7:
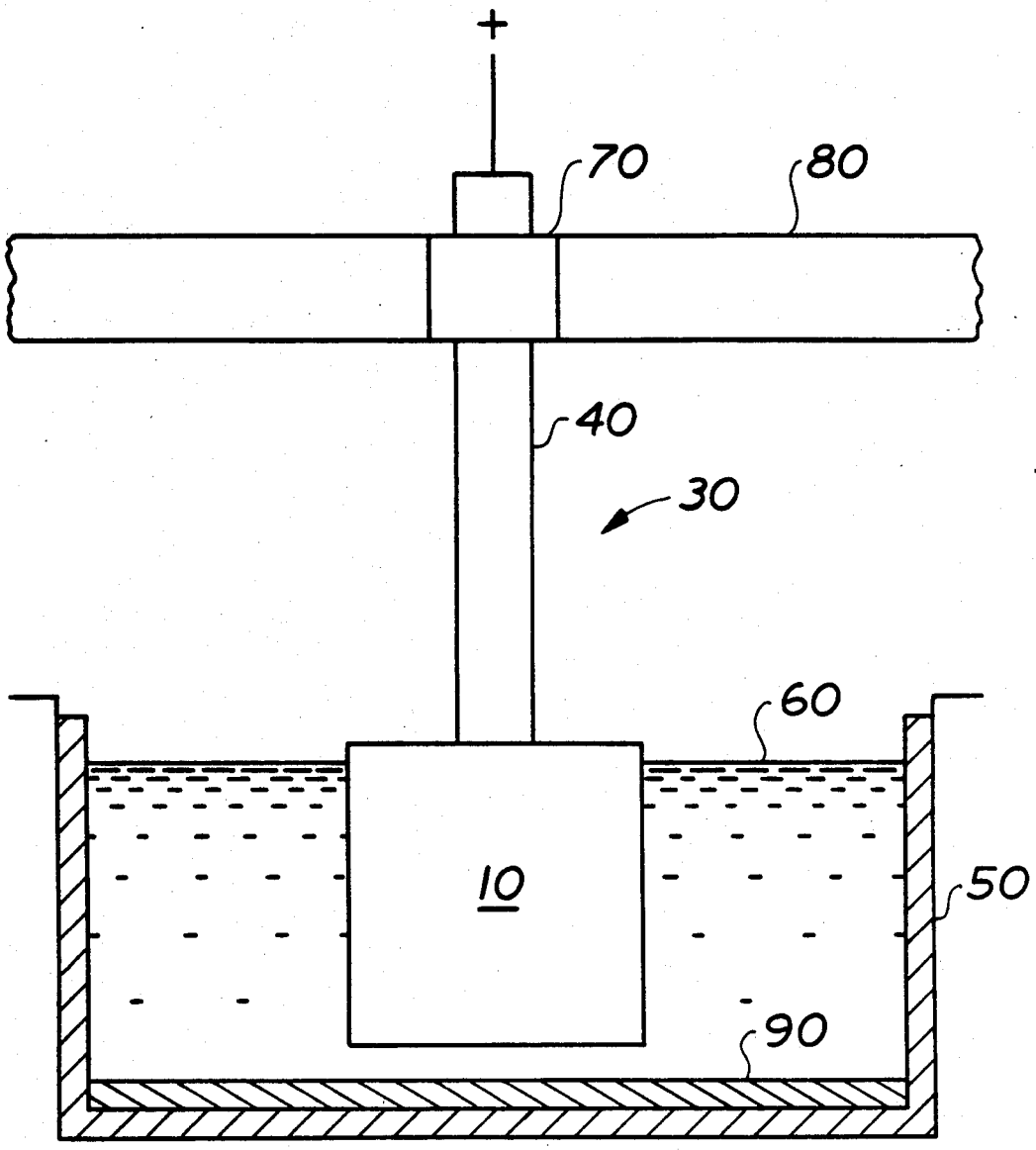
FIG. 7 is a cross section of an electrolytic cell for producing aluminum with an inert electrode assembly of this invention suspended therein.

FIG. 6 shows an alternate embodiment of an assembly of this invention which adds a measure of protection against corrosion of the principal current carrying portion of the connection when the assembly is used in the electrolytic production of a metal.

Figure 5:
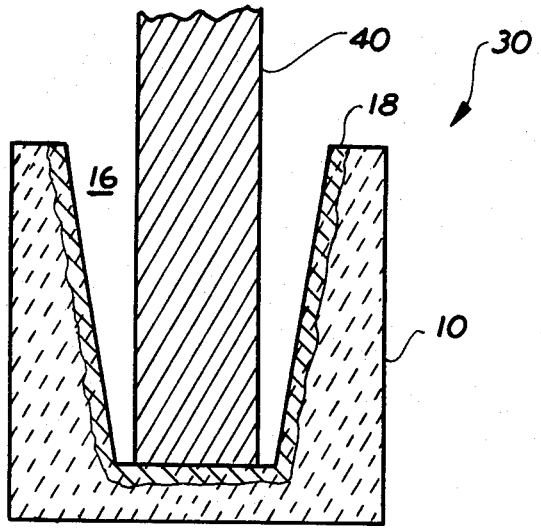
FIG. 5 is a cross-sectional view of the elements of an additional alternate embodiment of this invention prior to the elements being connected by friction welding.

The elements of the assembly 30, prior to friction welding, are an electrode body 10 and metal conductor 40, as shown in FIG. 5. The electrode body 10 is a closed end cylinder, preferably having an opening 16 which tapers inwardly from top to bottom. The body 10 preferably has the composition of materials described in connection with the embodiments shown in FIGS. 1 and 2 and is reaction sintered and provided with a reduced portion 18 within the opening in a manner as previously described.

The workpieces 40, 10 are friction welded into the assembly 30 as shown in FIG. 6 by the method previously described to make the assemblies shown in FIGS. 3 and 4.

As has been previously noted in friction welding bodies, the heat generated by the friction between the two bodies makes the metals in the bodies plastic in a zone adjacent to the heat generating body surfaces. When longitudinal pressure is then applied to effect the metal bond connection, at least some portion of the plastic metal is displaced as is evidenced by the upset that occurs between the two bodies while making the weld. In the assembly 30 shown in FIG. 6, the displaced metal 17 is utilized to fill, at least in part, the void between the body 10 and the rod 40 positioned in the opening 16. It may be seen that as the plastic metal 17 is displaced from the longitudinal pressure on the bodies, it is forced upwardly to fill at least some portion of the void between the body 10 and the rod 40 positioned in the opening 16. The extent of the upward movement of the plastic metal 17 is a function of a number of variables, such as the dimensional relationship between the rod 40 and the body opening 16, for example. Tapering of the opening 16 in the body is not essential, but it may be seen that the taper facilitates upward movement of the metal. Further, the extent of a welded metal bond connection away from the heat generating surfaces of the rod 40 and body 10 will vary with the extent of the temperature increase in the rod 40 and body 10 away from the heat generating surfaces. It is believed that with the proper dimensional relationship between the rod 40 and the body opening 16, and the use of suitable speed, pressure and weld cycle time in effecting the weld, the entire void surrounding the rod 40 can be filled with displaced metal 17 and a metal bond effected between the rod and body throughout the total depth of the opening 16.

Whether the void is completely filled or not, it may be seen that an assembly such as that shown in FIG. 6 would provide a connection having optimal strength, and displaced metal 17 would also function to shield the primary current carrying portion 19 of the connection adjacent to the bottom of the opening 16 from the products of electrolysis when the assembly is used in the electrolytic production of metal, as will now be explained.

Use of an assembly of this invention for producing aluminum by a typical electrolytic process is described with reference to FIG. 5. A container 50 suitable for containing a molten salt bath 60 is adapted as a cathode. Suitable cell materials and construction thereof are known to those skilled in the art.

The composition of the molten salt bath 60 is typically comprised of $Al_2O_3$ dissolved in a molten salt wherein the weight ratio of NaF to $AlF_3$ is maintained at approximately 1.1 and the salt bath further includes approximately 5 wt.% $CaF_2$ and 5 wt.% $Al_2O_3$. An anode assembly 30 of this invention as previously described is suspended in the molten salt bath by attaching the metal conductor 40 with a clamp 70 or other suitable suspension means known to those skilled in the art to a support means 80, and a positive lead from a power source is attached to the conductor 40. Preferably, the assembly 30 is suspended in the bath 60 with the upper edge of the anode body 10 above the level of the bath to minimize attack from the salt bath and products of electrolysis on the reduced interior of the body and the metal conductor 40.

In operating the cell, the bath 60 is maintained at approximately 960° C. and a current density of approximately 6.5 amps/in$^2$ (1 amp/cm$^2$) of surface area of the bottom of the anode body 10 is maintained with an anode-to-cathode distance of approximately 1½ inches (38 mm).

The process, when performed in such a manner, causes reduction of the dissolved $Al_2O_3$ with oxygen liberated at the anode 10 and molten aluminum 90 settling and collecting on the bottom of the cell 50.

The following examples are offered to further illustrate making a ceramic oxide body to metal conductor connection by a method of this invention.

EXAMPLES

A series of test assemblies of ceramic metallic oxide anode bodies and metal conductor rods were made with a Mode. No. 90B Inertia Welder, made by Manufacturing Technology, Inc., a subsidiary of Adams Engineering, Inc., Mishawaka, Ind.

The ceramic anode bodies were cylindrical solids with a 19 mm diameter and a 41 mm length and were comprised of 20 wt.% Fe, 60 wt.% NiO and 20 wt.% $Fe_3O_4$. The cylinders were reaction sintered in an argon atmosphere at a temperature of approximately 1275° C. for four hours at a pressure of 25,000 psi (172 MPa).

An end surface of each cylinder was then reduced to provide a surface having free metal particles therein by providing a layer of carbon on the surface to be reduced and heating the cylinder at a temperature of approximately 1000° C. for 12 hours in an argon atmosphere.

Metal conductor rods for connection to each cylinder were alloy 200 nickel and were 19 mm diameter × 52 mm long, and a portion on the end to be joined was machined to 12.7 mm diameter × 12.7 mm long.

The reduced surface of each anode cylinder and the end of each conductor rod to be joined were dry ground to a 32 RMS finish.

In making each anode body-conductor rod assembly, the anode body was mounted in a chuck in the weld machine which was adapted to rotate the body about its longitudinal axis. Since the ceramic material is relatively brittle, the body was encased in the chuck with the surface of the body to be joined to the metal rod recessed a distance of 2 mm from the face of the open chuck end. Providing support for the body in this manner prevented fracture of the body from the longitudinal force imposed upon the body during joining of the body to the rod by inertia welding.

The conductor rod was mounted in a non-rotating chuck in coaxial alignment with the anode body with the surface of the rod to be joined opposite of and spaced apart from the surface of the body to be joined. As noted previously, a portion of the conductor rod on the end to be joined was machined to a diameter of 12.7 mm and a length of 12.7 mm to insure sufficient clearance between the rod and the anode body chuck when the body and rod were joined.

With the anode body and metal rod workpieces mounted in the welding machine, the anode body was rotated at a predetermined speed, the anode body and metal rod were moved longitudinally in relation to one another to exert a predetermined axial load at the interface of the two workpieces for a brief period of time. Friction between the opposing faces of the body and rod quickly generated sufficient heat to place the metal particles in the body and the metal in the rod at and adjacent to the faces of the rod and body in a plastic state and continuation of the applied force caused fusion of the two workpieces at their interface. A clutch on the drive shaft having the anode body chuck thereon was then disengaged whereupon the shaft continued rotation at a decelerating rate from the effect of the inertial weight on the drive shaft until the rotation was stopped by the cooling and metallic fusion of the metals in the workpieces. A summary of the speeds, pressures and other criteria relative to making the welded samples is shown in Table I.

From a visual observation, each sample assembly appeared to be uniformly fused at the interface of the two workpieces and was judged to be satisfactorily welded for purposes of this invention.

TABLE I

| Sample # | Speed RPM | Longitudinal Pressure-PSI | wk[1] | Upset[2] mm | Weld cycle[3] (sec.) | Actual weld time[4] (sec.) |
|---|---|---|---|---|---|---|
| 1 | 5525 | 350 | .835 | 2.4 | 7.51 | 1.09 |
| 2 | 5525 | 350 | .835 | 2.4 | 9.34 | 1.06 |
| 3 | 5525 | 250 | .835 | 2.0 | 7.09 | 1.19 |
| 4 | 5525 | 250 | .835 | 1.6 | 6.28 | 1.31 |
| 5 | 7475 | 250 | .835 | 4.0 | 6.34 | 1.75 |
| 6 | 7475 | 250 | .835 | 4.0 | 5.91 | 1.69 |
| 7 | 7475 | 350 | .835 | 5.2 | 5.44 | 1.69 |
| 8 | 7475 | 350 | .835 | 5.2 | 5.69 | 1.53 |
| 9 | 6500 | 300 | .835 | 4.0 | 4.69 | 1.25 |
| 10 | 6500 | 300 | .835 | 3.2 | 4.69 | 1.34 |
| 11 | 6500 | 300 | .835 | 2.8 | 7.25 | 1.44 |
| 12 | 6500 | 300 | .835 | 3.6 | 7.56 | 1.38 |
| 13 | 5525 | 350 | .835 | 2.8 | 5.53 | 1.06 |
| 14 | 5525 | 250 | .835 | 2.4 | 7.00 | 1.13 |

Notes for Table I:

[1] $wk^2$ = wt. of inertial weight × (radius of gyration of inertial wt.)$^2$ for use in determining energy according to the equation:

$$\text{Energy (ft-lbs)} = \frac{RPM^2 \times wk^2}{5873}$$

[2] Upset is the difference in the combined length of the ceramic body and metal bar before and after joining. It is thus an indication of the extent of fusion at the interface of the workpieces.

[3] Weld cycle is the total time of acceleration of the rotating body, the application of pressure, and deceleration of the rotating body.

[4] Actual weld time is equal to the deceleration time.

Two of the above test assemblies were tested in a process for producing aluminum.

Each of the samples was tested in an electrolytic cell adapted for the production of aluminum, the cell containing a bath composition having NaF to $AlF_3$ in the weight ratio of approximately 1.1 and containing 5 wt.% $CaF_2$ and 5 wt.% $Al_2O_3$. In conducting the test the anode body was lowered into the electrolyte with the upper reduced anode surface and welded connection above the bath level, and the free end of the nickel rod was connected to a power lead from a current source. The cell was operated at an average bath temperature of 960° C. and a current density of 6.5 amps/in$^2$ (1 amp/cm$^2$) with an anode-to-cathode distance of approximately 1½ inches (38 mm).

One test assembly was run for 48 hours and the other was terminated after 9 hours due to a failure of the test cell equipment not related to the inert anode assembly. During the tests, current to each anode was individually monitored and controlled. Because of limited accessibility to the cell, the connection voltage was not monitored, but measurement of the total voltage drop in operating the cell indicated that the voltage drop across the connections was satisfactory.

Examination of the anodes after their respective runs revealed that the welds were intact and that the assemblies were suitable for producing aluminum in accordance with the process employed in the tests.

While the invention has been described in terms of preferred embodiments, the claims appended hereto are intended to encompass all embodiments which fall within the spirit of the invention.

What is claimed is:

1. A nonconsumable electrode assembly for use in the production of an element selected from the group consisting of aluminum, lead, magnesium, zinc, zirconium, titanium and silicon by electrolytic reduction of a compound comprised of such element dissolved in a molten halide salt, the assembly comprising:

a metal conductor for conveying electrical energy;

a ceramic electrode body having free metal or metal alloy in at least an outer surface portion thereof for making a connection between said metal conductor and said ceramic body; and a fused metal connection between said metal conductor and said portion of said ceramic electrode body said connection formed by friction welding a portion of said metal conductor to said outer surface portion of said ceramic electrode body.

2. The assembly in accordance with claim 1 wherein said welding is inertia welding.

3. The assembly in accordance with claim 1 wherein said outer surface portion is a chemically reduced portion of said ceramic electrode body.

4. The assembly in accordance with claim 1 wherein said free metal or metal alloy is selected from the group consisting of Fe, Ni, Al, Mg, Ca, Co, Sn, Ti, Cr, Mn, Zr, Cu, Nb, Ta, Li, Y, Pt, Pd and Ir.

5. The assembly in accordance with claim 1 wherein said ceramic electrode body includes at least one metal oxide.

6. The assembly in accordance with claim 5 wherein said outer surface portion is a chemically reduced portion of said ceramic electrode body.

7. The assembly in accordance with claim 1 wherein said ceramic electrode body includes at least one metal compound comprised of at least two metal oxides.

8. The assembly in accordance with claim 7 wherein said outer surface portion is a chemically reduced portion of said ceramic electrode body.

9. A process for producing an element selected from the group consisting of aluminum, lead, magnesium, zinc, zirconium, titanium and silicon by electrolytic reduction of a compound comprised of such element dissolved in a molten salt, said process including providing a nonconsumable anode assembly by the steps of:

providing a metal conductor for conveying electrical energy;

providing a ceramic electrode body having free metal or metal alloy in at least an outer surface portion thereof for making a connection between said metal conductor and said ceramic body; and connecting said ceramic body to said metal conductor by friction welding a portion of said metal conductor to said portion of said ceramic body having the free metal or metal alloy therein.

10. A process in accordance with claim 9 wherein said friction welding is inertia welding.

11. A process in accordance with claim 9 wherein said free metal or metal alloy is provided by chemically reducing said outer surface portion of said ceramic body.

12. A process in accordance with claim 9 wherein said free metal or metal alloy is selected from the group consisting of Fe, Ni, Al, Mg, Ca, Co, Sn, Ti, Cr, Mn, Zr, Cu, Nb, Ta, Li, Y, Pt, Pd and Ir.

13. A process in accordance with claim 9 wherein said ceramic electrode body includes at least one metal oxide.

14. A process in accordance with claim 13 wherein said outer surface portion is a chemically reduced portion of said ceramic electrode body.

15. A process in accordance with claim 9 wherein said ceramic electrode body includes at least one metal compound comprised of at least two metal oxides.

16. A process in accordance with claim 15 wherein said outer surface portion is a chemically reduced portion of said ceramic electrode body.

* * * * *